US005632171A

United States Patent [19]

Kunka et al.

[11] Patent Number: 5,632,171

[45] Date of Patent: May 27, 1997

[54] IRONING PRESS LAMINAR FLOW LUBRICATION RING

[75] Inventors: James L. Kunka, Powhatan County; Donald R. Haulsee, Chesterfield County, both of Va.

[73] Assignee: Reynolds Metals Company, Richmond, Va.

[21] Appl. No.: 595,123

[22] Filed: Feb. 1, 1996

[51] Int. Cl.[6] ..... B21B 45/02

[52] U.S. Cl. ..... 72/43; 72/41

[58] Field of Search ..... 72/41, 43, 44, 72/45, 349; 277/13, 14 R, 59, 68, 69

[56] References Cited

U.S. PATENT DOCUMENTS

| | | | |
|---|---|---|---|
| 1,459,819 | 6/1923 | Bonner . | |
| 3,285,004 | 11/1966 | Hopley . | |
| 3,581,728 | 6/1971 | Abraham . | |
| 3,653,249 | 4/1972 | Dunn | 72/349 |
| 3,943,740 | 3/1976 | Bartenstein | 72/45 |
| 3,951,476 | 4/1976 | Schulien et al. . | |
| 4,223,544 | 9/1980 | Main | 72/45 |
| 4,262,512 | 4/1981 | Maeder | 72/45 |
| 4,300,375 | 11/1981 | Maeder et al. | 72/45 |
| 4,345,451 | 8/1982 | Pamplin et al. | 72/41 |
| 4,881,394 | 11/1989 | Jansen . | |
| 5,020,350 | 6/1991 | Knepp et al. | 72/45 |
| 5,460,024 | 10/1995 | Meneghin et al. . | |
| 5,465,691 | 11/1995 | Capaldo . | |

*Primary Examiner*—Lowell A. Larson
*Assistant Examiner*—Rodney A Butler
*Attorney, Agent, or Firm*—Robert C. Lyne, Jr.

[57] ABSTRACT

A lubrication ring, for use in a fabrication press having an assembly with a main cavity and a die nib disposed on a surface of the cavity for ironing a workpiece passing through the cavity, includes a groove surrounding a periphery of and opening into the main cavity of the assembly. At least one passage is provided for introducing a fluid into the groove so as to flow within the groove. The fluid is introduced into the groove at a velocity which causes a centrifugal force exceeding the force of gravity to act on the fluid flowing in the groove.

20 Claims, 8 Drawing Sheets

IRONING PRESS LAMINAR FLOW LUBRICATION RING

BACKGROUND OF INVENTION

1. Field of the Invention

The present invention relates generally to drawing and ironing (D&I) presses such as those used in forming drawn and ironed containers, and more particularly to an improved lubricating ring for use in such presses.

2. Description of the Related Art

In the formation of a container, it has been customary to utilize dies that cooperate with a punch for converting, for example, circular metal or metalloplastic discs, commonly referred to as blanks, into finished cans or other forms of containers. Typically, this is accomplished in a two-step process. The circular disc is first formed into a cup and then the cup is drawn and ironed through dies to thin and lengthen the side walls. The step of forming the disc into a cup is typically performed in a cupping press while the conversion of the cup into the finished product is performed by a D&I press or bodymaker. In a typical application, the cup may be forced through multiple ironing dies. The bodymaker uses a punch to force the cup through the ironing dies to form the finished container.

In ironing the side wall of the cup to create the finished container, the workpiece is severely worked as it passes through the dies. Typically, bodymakers operate at very high speeds to efficiently produce the required volume of finished containers economically. For example, a single bodymaker may be operated to produce 300 to 500 or more finished containers per minute. Such high speed operation adds to the stress on the dies and to the heat generated during the process.

To minimize the amount of friction between the workpiece and die components, and the associated heat generated therein, it is customary to lubricate the surfaces of the dies which actually contact the workpiece, i.e., the die nibs. The nib may be formed of carbide or other material of suitable strength for the intended application. The lubricant reduces friction between the nib and workpiece during container formation and also serves as a coolant.

Without proper lubrication and cooling, the workpiece may be distorted or torn, and the die nibs may be damaged or their life reduced, during working of the container. Additionally, increased metal fines or shavings from the workpiece may be produced, thus reducing the life and/or effectiveness of the lubricant itself and lubricant filter. Further, if cooling is insufficient, the distance between the opposed surfaces of the nib and punch may increase or decrease, depending on the nib and punch materials, to an undesirable level making it impossible to produce containers having the required sidewall thickness. For example, if a carbide die nib and steel punch are utilized, the punch will have a greater coefficient of expansion than the nib. Accordingly, as the heat generated during the working of a workpiece increases, the distance between the punch and die nib will decrease to an unacceptable level. On the other hand, if both the punch and nib are formed of carbide, the punch will typically stay somewhat cooler than the nib. As the heat generated during the working of the workpiece increases, the distance between the punch and nib may actually increase to an unacceptable level. In a typical can making application, if the distance between the nib and punch diameters are out of tolerance by more than 0.0002 inches, e.g. more than 0.0001 inches on each side, the finished container will either have sidewalls which are formed too thin or too thick. If the sidewalls are too thin the container will generally fail to meet the customer's specification. If too thick, the resulting finished container may have sidewalls of insufficient length to provide enough excess material to allow the end of the finished container to be cut to form a smooth edge surface.

Numerous techniques for lubricating and cooling the dies and the workpiece have been proposed. Such techniques have generally provided for a continuous flow of the lubricating fluid during operation of the bodymaker so that cooling can continue even when no workpiece is being worked by the press.

Lubricating rings formed as part of a die assembly with drop-in dies, or formed separate from but arranged adjacent to the dies in a tool pack assembly, are often utilized to direct lubricant into the die cavity through which the workpiece will be drawn and ironed into the finished container. The lube rings function to orient and direct the flow of the lubricant toward the die nibs. More particularly, holes, channels or grooves are machined into the lube ring to direct pressurized lubricating fluid toward the portion of the die nibs which will come in contact with the workpiece to thin and lengthen the side walls of the cup and thereby form the desired finished container. The lubricant may, for example, be composed of water in combination with oils, fats or other materials having suitable qualities.

In practice, the orienting and directing of the flow of lubricant is not a simple task because the working surface of the nib is on the inner periphery of the tool pack or die assembly cavity through which the workpiece is drawn by the punch. The inner diameter of the lube ring must be greater than the diameter of the working surfaces of the nibs so as to avoid interference with the workpiece as it passes through the cavity. Hence, it is extremely difficult to direct a fluid spray onto the working surface of the nib.

Lube rings have been proposed with a circular array of small holes which are angled to direct a fluid spray as close as possible to the working surface of the nibs. Other proposed lube rings have a groove machined into the ring which is formed so that the lubricant is squeezed out of the groove at an angle so as to direct a lubricant spray as close as practicable to the working surface of each nib. Still other proposed lube rings include a circular array of slots machined into the ring to direct a fluid spray toward the working surface of the nibs. In each case, the fluid spray is directed at a high velocity toward the main cavity of the press die assembly or tool pack and the working surface of the nibs. Such lube rings, at best, provide less than optimum lubrication to the nib working surface. This is because proposed lube rings fail to deliver the lubricant so that the die nibs are completely and uniformly coated. Further, a slightly improper orientation of the ring outlet(s) or a minor change in the velocity of the fluid from the outlet(s) can result in the lubricant jetting past or otherwise missing the working surface of the nibs. Hence, sufficient lubrication and cooling will not be provided.

The key to preventing undesirable stresses and heat on the die components and workpiece is to uniformly, completely and consistently coat the working surface of each nib of the ironing die with the desired lubricant. Hence, there is a need for an improved lubricating and cooling technique for use in drawing and ironing workpieces.

OBJECTIVES OF INVENTION

Accordingly, it is an object of the present invention to provide a lubricating ring for lubricating and cooling ironing press die nibs and workpieces without the above noted problems.

It is a further object of the present invention to provide a lubricating ring in which the orientation of the lubricant outlets and output velocity of the lubricating fluid from the ring is less critical than in previously proposed lube rings.

It is another object of the present invention to provide a lubricating ring which provides a flow of the lubricating fluid to uniformly and completely coat the working surface of a die nib.

Additional objects, advantages and novel features of the present invention will become apparent to those skilled in the art from this disclosure, including the following detail description, as well as by practice of the invention. While the invention is described below with reference to preferred embodiments, it should be understood that the invention is not limited thereto. Those of ordinary skill in the art having access to the teachings herein will recognize additional applications, modifications and embodiments in other fields which are within the scope of the invention as disclosed and claimed herein and with respect to which the invention could be of significant utility.

SUMMARY OF THE INVENTION

In accordance with the present invention, a lubricating ring is provided for use in a fabrication press. The fabrication press includes an assembly having a main cavity and at least one nib disposed on a surface of the cavity for ironing a material which is forced by a punch through the cavity. The assembly also includes one or more lubricating rings. Each lubricating ring has a groove which surrounds a periphery of the main cavity and opens into the cavity. One or more passages are provided for introducing a fluid into the groove. The passages are preferably formed tangential to the groove so that the fluid through each passage is directed in the same radial direction within the groove. The fluid is introduced into the groove at a sufficient velocity to cause a centrifugal force to act on the fluid flowing in the groove such that the fluid maintains contact with the groove surface. That is, the velocity must be sufficient to overcome the gravitational forces which will tend to separate the fluid from the groove surface. Preferably, the centrifugal force exceeds the gravitational force exerted on the fluid flowing within the groove. The necessary velocity can be calculated in a conventional manner.

As a volume of fluid is introduced into the groove, the fluid will be forced to flow out of the groove opening and onto the surface of the die nibs extending from the assembly main cavity. The velocity should be sufficient to compensate for any decrease in the fluid flow velocity resulting from, for example, friction and gravitational forces exerted on the fluid between the inlets of the grooves and nib surface. This will ensure that centrifugal force on the fluid flowing from the groove will maintain a laminar flow even after exiting the groove opening. The fluid flowing from the groove opening is thereby maintained in continuous contact with the cavity and nib surfaces.

In the typical application, the main cavity of the assembly is cylindrical and accordingly the groove is formed circumferentially around the cavity. Hence, the fluid is introduced so that it flows in a single radial direction circumferentially around the periphery of the cavity.

In operation, the lubricating ring introduces a fluid which not only lubricates the nib surfaces to reduce the coefficient of friction between the nibs and the workpiece, but also serves as a coolant and cleaner to remove heat and fines from the dies and workpiece generated during operation of the press. Preferably the fluid is applied continuously during the period of operation of the press, whether or not a workpiece is being worked. In this way, continuous cooling of the press die is beneficially performed.

Thus, by introducing a fluid to the main cavity of the die/lubricating ring assembly under an applied pressure force which causes the fluid to flow at a velocity around the periphery of the assembly main cavity sufficient to develop a centrifugal force on the fluid exceeding the gravitational force on the fluid, the fluid can be made to maintain a laminar flow over the nib surface. By continuously supplying fluid at the proper velocity into the groove during operation of the press, the fluid will beneficially maintain continuous contact with the surfaces of the nib.

FIGS. **8*a*–8*f*** depict alternative lube ring groove configurations in accordance with the present invention.

DESCRIPTION OF THE PREFERRED EMBODIMENT

Figure 1:
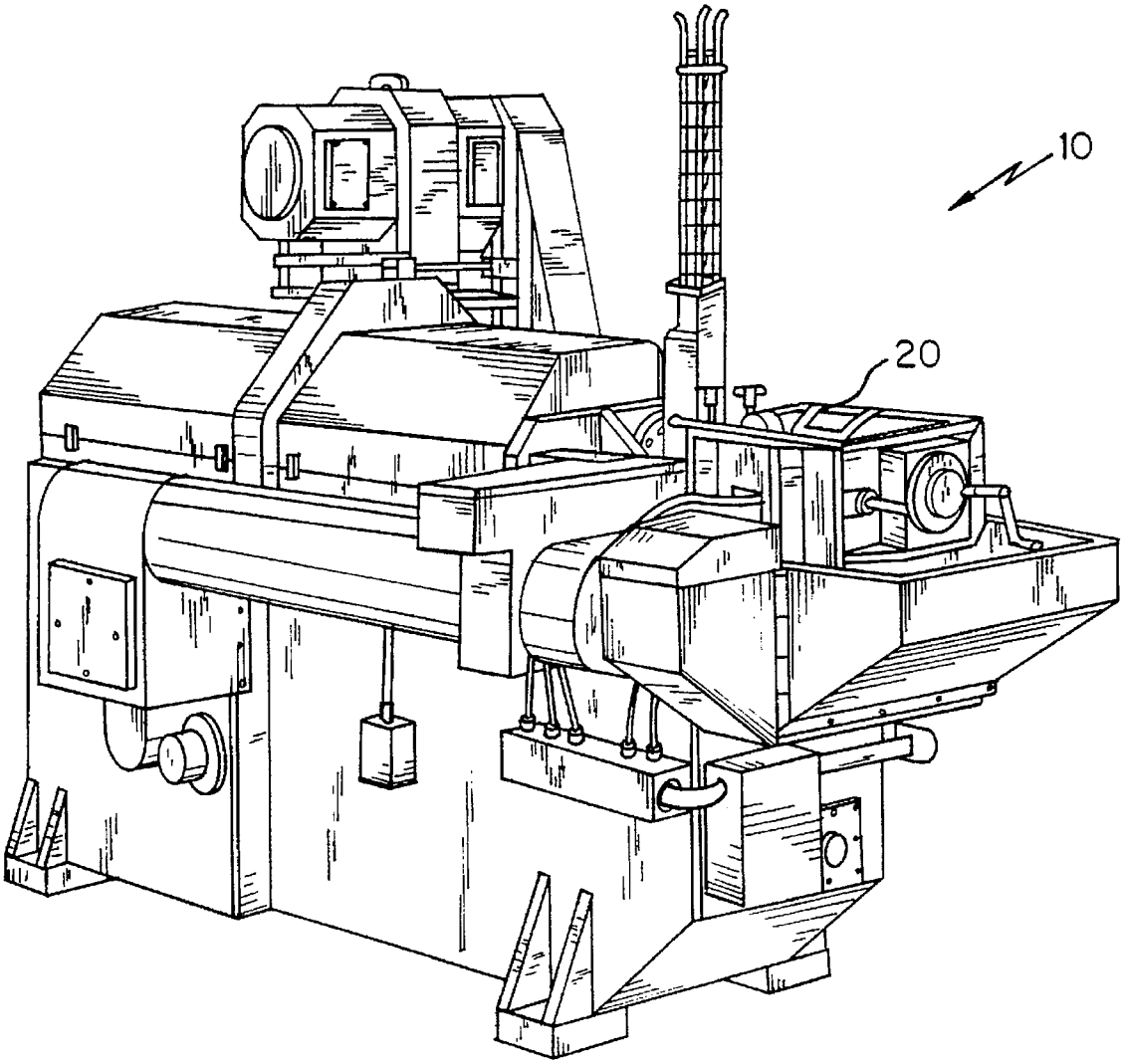
FIG. 1 is a perspective view of a typical can bodymaker which provides a suitable environment for the laminar flow lube ring of the present invention.

FIG. 1 depicts a typical can bodymaker or press 10 which can serve as a background environment in which a lube ring of the present invention can be utilized. Bodymaker 10 includes a typical die or tool pack assembly 20 for drawing and ironing workpieces into the desired finished container. It will be understood that the bodymaker 10 is simply one type of drawing and ironing device in which the present invention can be utilized. The lube ring of the present invention can be utilized with virtually any die or tool pack assembly and in virtually any type of fabrication machinery which requires a lubricant to be formed between a machine part or workpiece. Accordingly, the bodymaker 10 and the assembly 20 which is further detailed below are merely typical of the type of devices in which the present invention can be beneficially utilized.

Figure 2A:
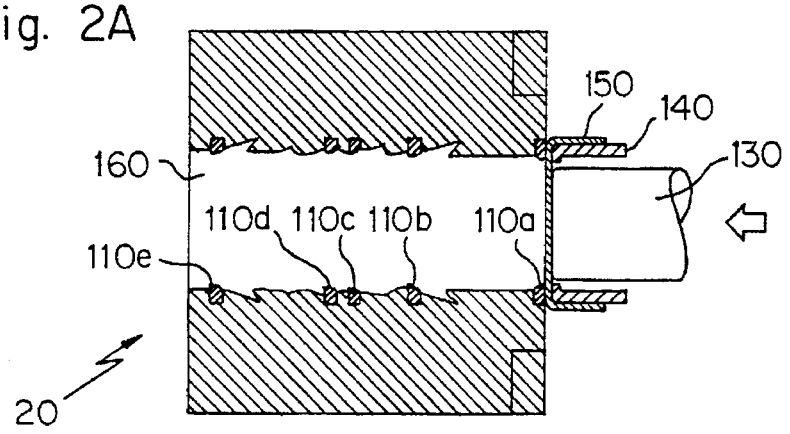
FIGS. 2A–2C depict exemplary side sectional views of the die and lube ring assembly cavity during the drawing and ironing of a container in the FIG. 1 bodymaker.
Figure 2B:
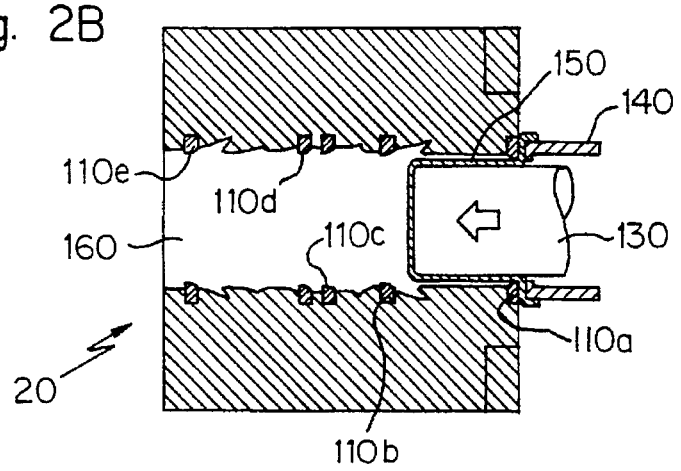
Figure 2C:
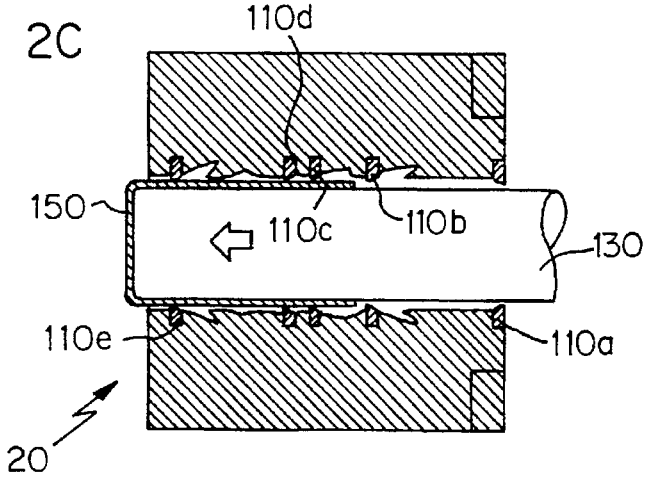

FIGS. 2A–2C depict a schematic partial side sectional view of the assembly 20 during various stages in the operation of the bodymaker 10. It should be noted that bodymaker 10 may be continuously operated whether or not a workpiece is being drawn and ironed by the assembly 20.

FIG. 2A depicts assembly 20 supporting die nibs **110*a–e*, a mandrel or punch 130 and cup holder sleeve 140 engaging the workpiece 150. The sleeve 140 presses the cup against the face of the first die nib 110*a* which is part of a die often referred to as the redraw die or ring. Accordingly, the workpiece 150 will be pressed by the punch 130 in the direction indicated by the arrow into the cavity 160 of the assembly 20**.

FIG. 2B depicts the punch 130 as it moves the workpiece 150 into the cavity 160 of the assembly 20. The workpiece 150 is drawn past the initial die nib 110*a* and toward the die nibs 110*b*, 110*c* and 110*d*, often respectively referred to as the nibs in the first and middle ironing dies and the pilot die, or the first and second die rings and the pilot die ring.

As shown in FIG. 2C, the workpiece 150 is pressed by the punch 130 past the pilot die nib 110*d*. The pilot die nib 110*d* protects the last ironing die nib 110*e*, which is customarily referred to as part of the end ironing die or third die ring, by maintaining punch centering even when the workpiece is of uneven length as it passes die nib 110*c* of the second ironing die ring 100*c* and preventing breakage of the edge on the longer length side of the workpiece. As indicated, the ironing is performed exclusively by die nibs 110*b*, 110*c* and 110*e*.

It should be noted that the workpiece 150 may be of metal, metalloplastic or some other malleable material. The workpiece 150 is typically formed into a cup shape as shown in FIG. 2A prior to being pressed into the cavity 160 of the assembly 20.

FIGS. 3A–3D depict portions of the assembly shown in FIGS. 2A–2C in greater detail.

Figure 3A:
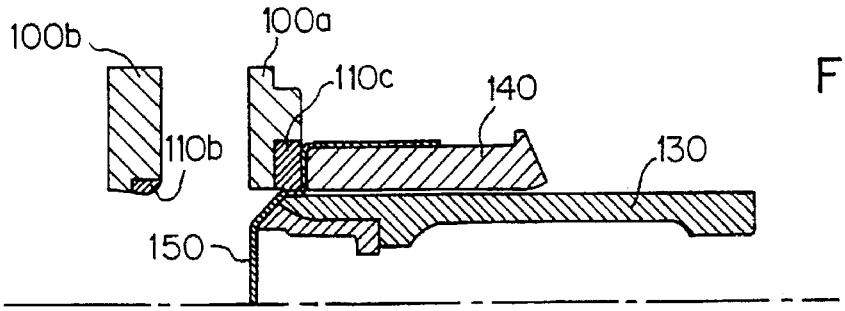
FIGS. 3A–3D depict portions of the assembly shown in FIGS. 2A–2C in greater detail.

As shown in FIG. 3A, the workpiece 150 has an initial sidewall thickness of approximately 0.0118 inches as it is pressed by the punch 130 past the redraw die 110*a* which is part of the redraw ring 100*a*. At this point, the work piece 150 is still engaged by the holder sleeve 140.

Figure 3B:
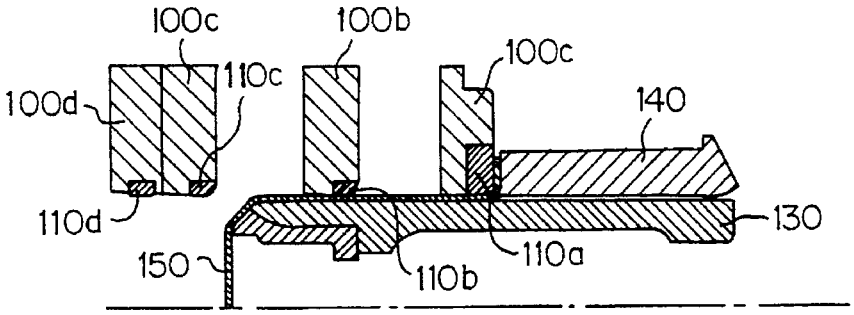

In FIG. 3B the lead portion of the workpiece 150 sidewalls have passed through ironing die nib 110*b* of the first ironing ring 100*b* and has been thinned to 0.0095 inches. As shown in FIG. 3B, no thinning of the workpiece 150 sidewalls is performed by the redraw die 100*a*.

Figure 3C:
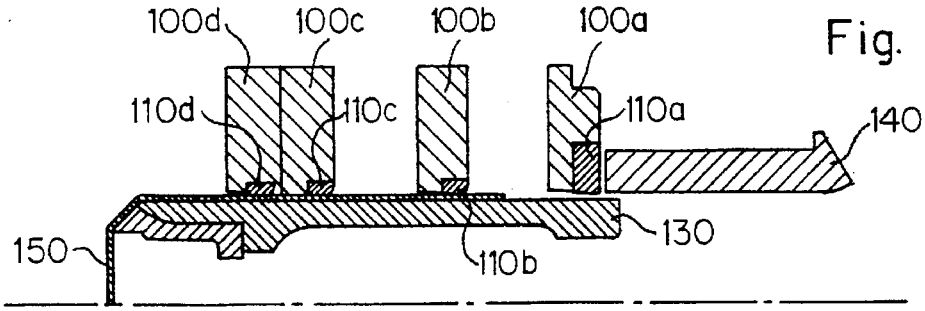

FIG. 3C depicts the workpiece 150 as it passes through the second die ring 100*c* which supports nib 110*c* and the pilot die ring 100*d* supporting nib 110*d*. As indicated, the sidewalls of workpiece 150 are further thinned by the second die ring 100*c* to 0.0069 inches. The pilot die ring 100*d* performs a centering operation to keep the punch centered notwithstanding the workpiece being of uneven length and also protects the workpiece from breakage of the longer side edge. As indicated, the pilot die ring 100*d* does not further thin the sidewall of the workpiece 150 which remains at 0.0069 inches even after proceeding past the nib 110*d*.

Figure 3D:
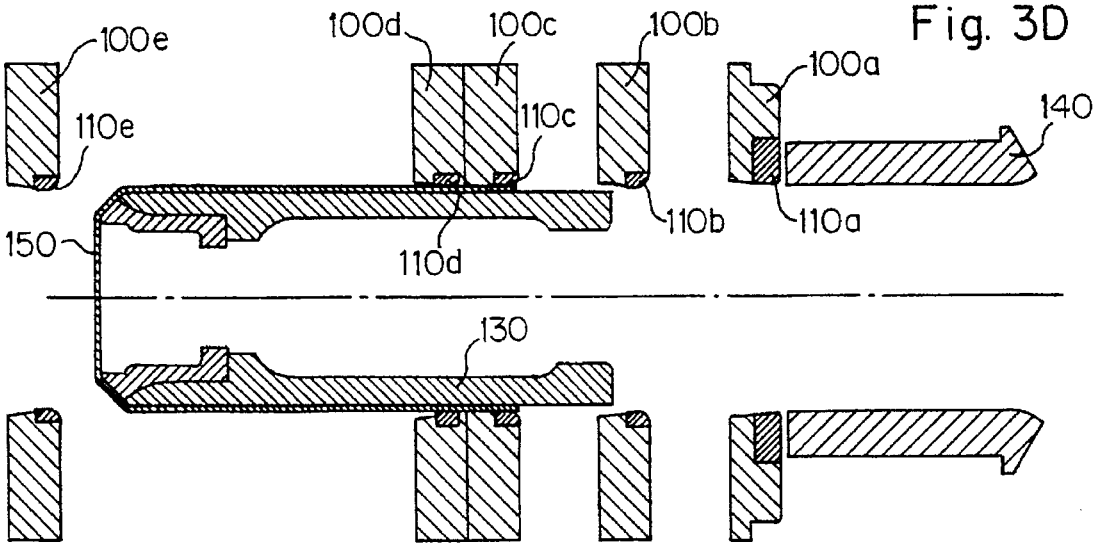

FIG. 3D depicts the workpiece 150 just prior to passing through the third die ring 100*e* which supports nib 110*e*. Although not indicated, it will be understood that the final thinning of the workpiece 150 is performed by the third die ring 100*e* before the workpiece is forced by the punch 130 out of the cavity as a finished container.

Figure 4:
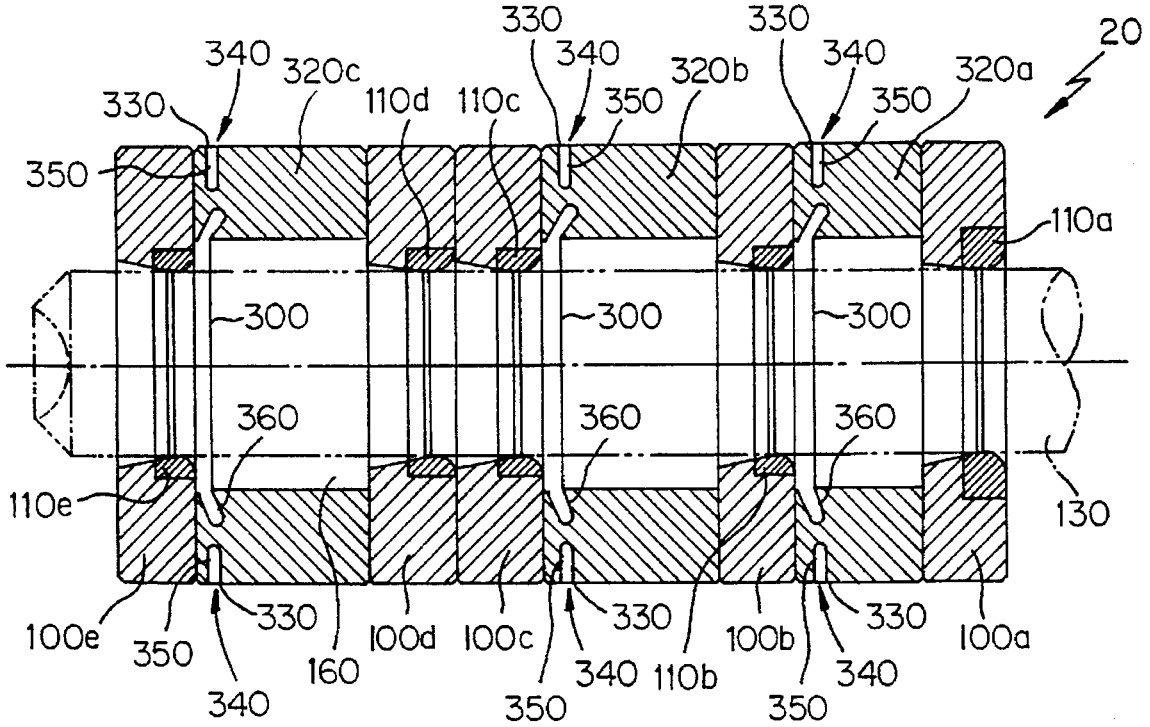
FIG. 4 is a more detailed side sectional view of the assembly depicted in FIGS. 2A–2C showing the lube ring of the present invention.

FIG. 4 is a more detailed side sectional view of the assembly 20 with the punch 130 depicted by the dotted lines. The assembly 20 is formed of tungsten carbide dies 110*a* through 110*e* in the die bearer rings 100*a* through 100*e* which are separated by spacers or sleeves 320*a*–320*c* which include lube rings 300. The sleeves 320*a*–320*c* may beneficially have increasing lengths as shown. It should be understood that in drawing a workpiece through the cavity 160 of assembly 20, the workpiece may or may not be in contact with two successive die nibs after first coming into contact with die nib 110*b*. Each sleeve includes one or more ports 330 for introducing a lubricating and cooling fluid 340, such as a water based lubricant including oils or fats, into one or more passages 350 which feed the fluid 340 into a groove 360 in lube ring 300 from which the lubricant flows into the main cavity 160 of assembly 20. The lubricating ring 300 is further described below.

It will be noted that no lubricating ring is located between the second die ring and the pilot die ring in the preferred embodiment shown in FIG. 4. However, it will be understood that if desired a further lubrication ring 300 could be disposed between die ring 100*c* and die ring 100*d*.

Figure 5:
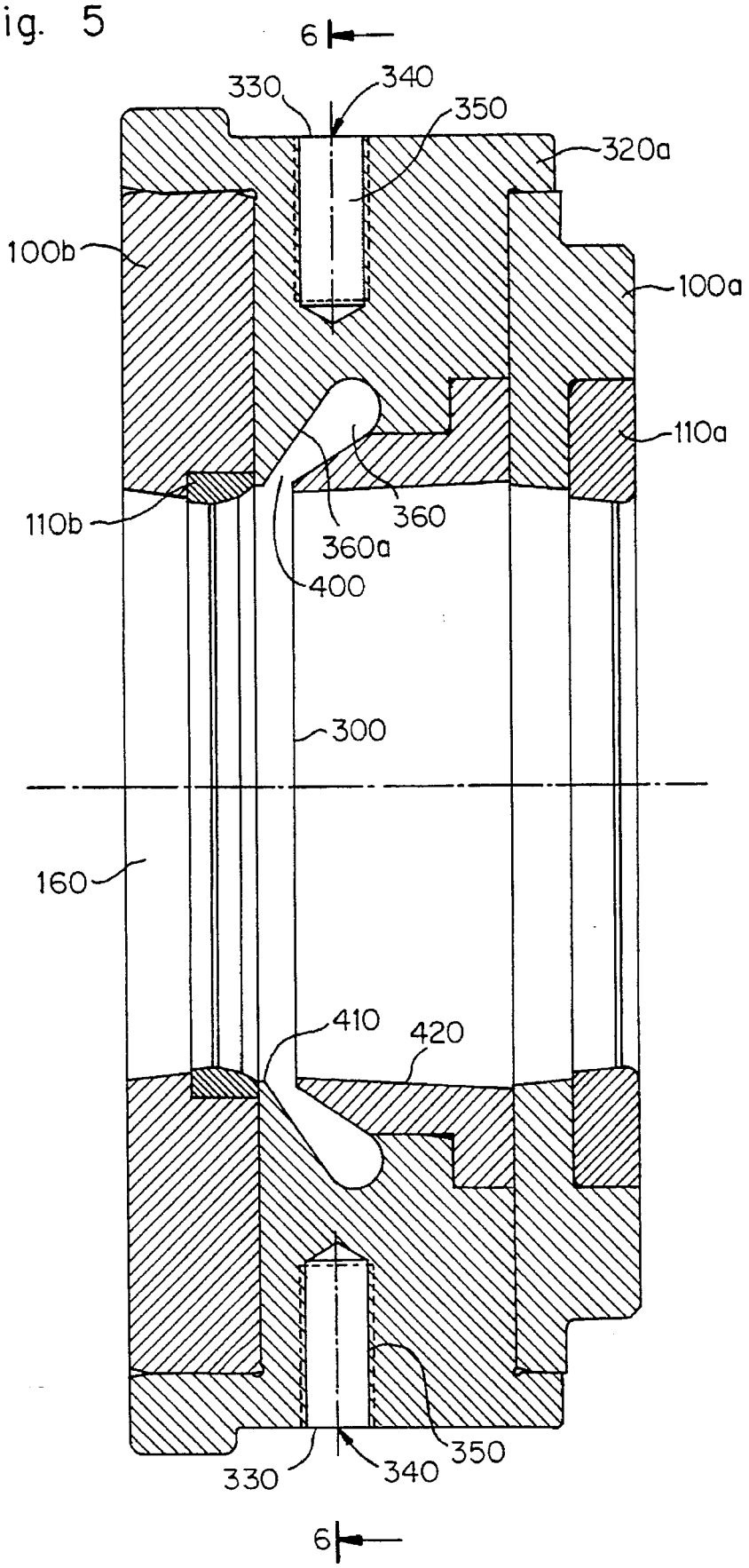
FIG. 5 is an expanded side sectional view of a die and lube ring arrangement in accordance with the present invention.

FIG. 5 is an expanded view of the redraw ring 100*a* and the first die ring 100*b* with the sleeve 320*a* disposed therebetween. As shown in FIG. 5, the lubricant 340 is fed into the port 330 and directed via the passageway 350 into groove 360. The passageways 350 are formed to merge tangentially with the lube ring 300. Although preferably four passages 350 are utilized in the preferred embodiment, for specific applications a fewer or greater number of passages may be beneficially utilized. The groove 360 is formed in part by bushing 420 to avoid the need for complex machining to form the grove. Thus, as shown in FIG. 5, substantially cylindrical cavity 160 is defined by toroidal die ring 100*b*, die nib 110*b*, sleeve 320*a*, bushing 420, redraw ring 100*a*, and die nib 110*a*, while annular groove 360, which opens into cavity 160, is defined by sleeve 320*a* and bushing 420.

The fluid 340 is input into port 330 at an input velocity of 100 inches per second. The fluid travels through the passageway in 350 and into groove 360 which is contiguous around the periphery of the cavity 160. At the above noted input velocity, the lubricant 340 will be subject to a centrifugal force of approximately 20 g's as it travels circumferentially around the groove 360 of the lube ring 300. The centrifugal force will cause the fluid 340 which enters the groove 360 to be in continuous contact with the groove surface 360*a* while the fluid remains in the groove 360. The lubricant 340 is continuously input into ports 330 and thus is continuously introduced by passageway 350 into groove 360 during operation of the bodymaker 10.

Although groove 360 is depicted in a tear drop shape, virtually any size or shape of groove can be utilized in accordance with the present invention. For example, a rectangular or semicircular shaped groove could be utilized. FIGS. 8*a*–8*f* depict various exemplary alternative groove shapes which could be preferred for certain applications. In the embodiment detailed herein, the groove opening 400 is preferably no greater than the diameter or widest portion of the passageway 350. It is also preferable that the depth of the groove 360 be approximately two times the diameter or widest dimension of the passageway 350. Although passageways 350 are depicted as cylindrical, the shape of the passageway is not necessarily limited thereto, but could take any shape which is deemed desirable for the applicable application. As shown, the passageway 350 has a diameter of approximately 0.281 inches. The depth of the groove 360 is slightly greater than 0.500 inches. The length of the passageways themselves are preferably at least twice the diameter or widest portion of passageway 350. In the preferred embodiment, the passageways 350 have a length of close to 1.0 inches.

Figure 6:
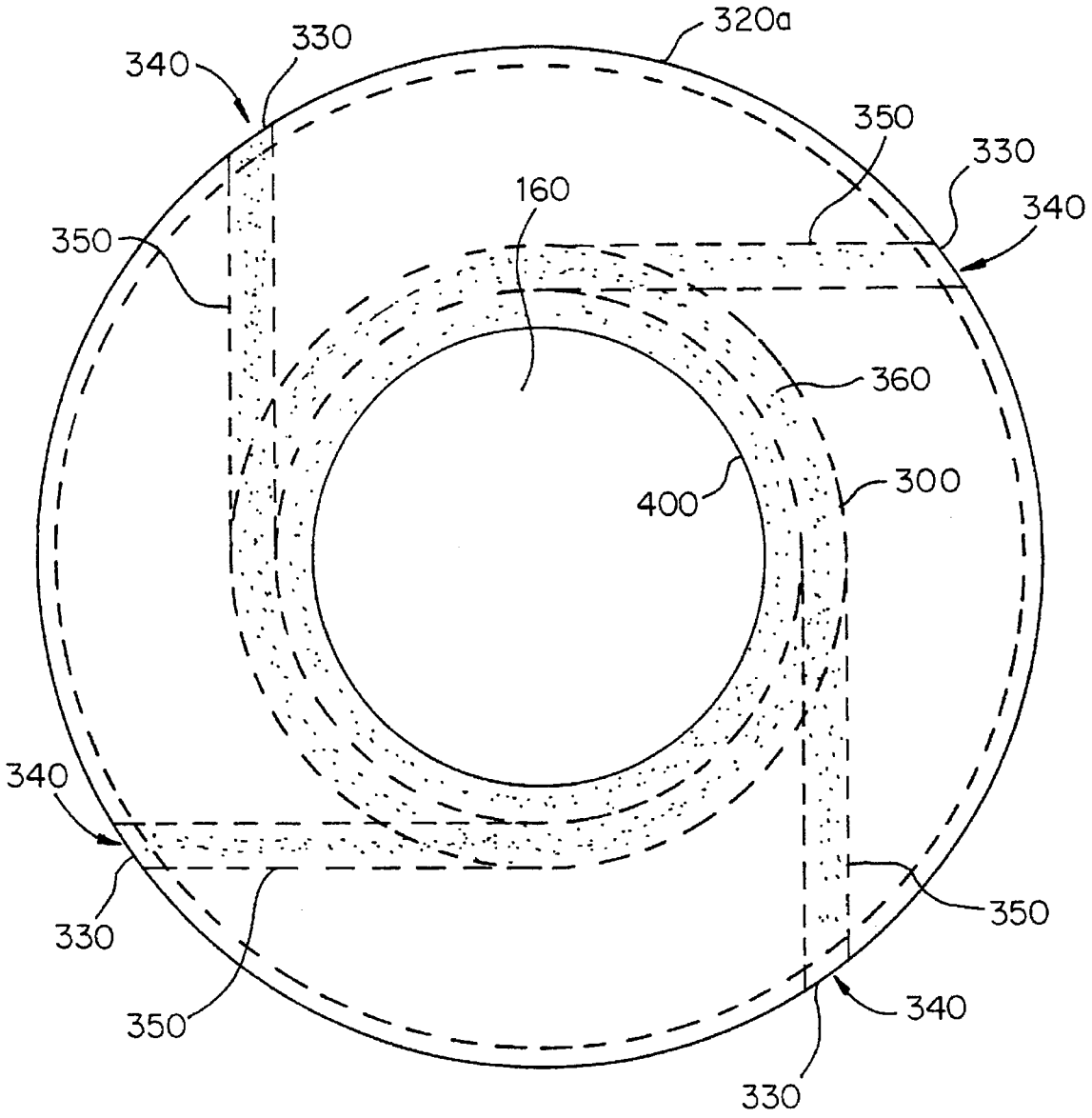
FIG. 6 depicts a cross-sectional view of the lube ring depicted in the FIG. 5 arrangement in accordance with the present invention.

FIG. 6 depicts a cross-sectional view of the spacer 300*a*. As shown in FIG. 6, the lube ring 300 includes a continuous single groove 360 which surrounds the periphery of the cavity 160. Fluid 340 is fed at a high velocity into passages 350 via input ports 330. The fluid is directed by the passages 350 into the lube ring groove 360 at a sufficient velocity to develop a centrifugal force on the fluid flowing around the groove 360 which exceeds the gravitational forces on the fluid. This causes the fluid to have a laminar flow around the groove 360 of the lube ring 300 to maintain contact with, i.e., not separate itself from, the groove 360 surface even at the upper portions of the ring. As more and more fluid 340 is introduced into the groove 360 via passages 350, fluid is forced from the lube ring groove 360 via the opening 400 in the lube ring 300. As noted above, the width of the groove 360 does not necessarily have to decrease toward the opening 400. The velocity of the fluid as it enters the groove 360 must be sufficient to overcome any losses in velocity of the fluid between its entry into the groove 360 from the passages 350 until it flows over nib 110*b*. Such losses could be caused, for example, by friction and gravitational forces acting on the fluid as it flows through the lube ring 300 and over the nib 110*b*. Hence, the input velocity of the lubricating fluid 340 must be such that a centrifugal force at least equal to the force of gravity continues to act on the fluid as it flows over nib 110*b* to ensure a laminar flow over the nib 110*b*.

As shown in FIG. 5, the lubricant which egresses the groove 360 via opening 400 first contacts a small portion of the cavity surface 410 before flowing onto the nib 110*b*. However, if desired, the lubricant could directly flow from the opening 400 onto the surface of nib 110*b* without first contacting cavity surface 410. In either case, the lubricant maintains a laminar flow through the opening 400 and onto the nib 110*b*. The laminar flow beneficially continues to a discharge port (not shown) if the input velocity is properly selected in a manner which will be well understood by those skilled in the art.

As discussed above, the fluid enters the groove 360 tangentially through the four passageways 350. The velocity of the fluid entering the port 340 of each passageway 350 is at a velocity of approximately 100 inches per second. The fluid introduced to the groove 360 immediately conforms to the grooves radius curvature and is therefore subject to a centrifugal force which exceeds the gravitational force on the fluid as it circles the periphery of the cavity 160. In the preferred embodiment, the lubricant fluid input velocity has been established so that the fluid is subject to approximately 13.3 g's of centrifugal force as it circles the periphery of the cavity 160.

As can be best seen in FIG. 6, the fluid flowing in groove 360 crosses the path of fluid entering the groove as it passes the output port of each passageway 350. The additional fluid being input through passageways 350 forces the flowing fluid particles toward the opening 400 in the groove lube ring 300. In effect, the fluid particles form a spiral toward the opening 400 of groove 360. The tangential velocity of the fluid remains essentially constant as it spirals inward, although slight friction and gravitational losses may be experienced. The rotational speed of the fluid, i.e., revolutions per minute, increases as it spirals inward because the radius of the circumferential flow continues to decrease as the fluid particles move toward the opening 400. As the fluid discharges from the opening 400, the centrifugal forces on the fluid are approximately 20 g's.

As a result of the high centrifugal forces caused by the input velocity of the lubricant 340, as the fluid flows from the opening 400 it remains contiguous and follows the surface 410 of the cavity 160 onto the surface of the nib 110*b*. The fluid 340 completely coats the entire surface of the nib notwithstanding the changes in the diameter of the various nib surfaces.

Contrary to conventional teaching that water-like fluids cannot maintain a laminar flow with Reynolds numbers greater than 2000, the present invention results in a laminar flow of a lubricating fluid primarily comprised of water along the surface 360*a* of groove 360 and continuing onto surface 410 of the cavity 160 and thereafter onto the surface of nib 110*b* at a very high Reynolds number of approximately 20,000.

Due to this laminar flow, the fluid maintains intimate contact with the lube ring 300 and the cavity and nib surfaces. To obtain this laminar flow at the nib 110*b* surface, the velocity of the fluid flowing over the nib must be sufficient to develop a centrifugal force which equals or exceeds the gravitational force on the fluid as it flows over the surface of the nib. In our testing of the present invention, this intimate contact has been shown to continue as the fluid flows onto surfaces orthogonal or perpendicular to the upstream surfaces on which the fluid flows.

Although conventional fluid mechanics teach that heat transfer to a fluid with laminar flow is poor, the lube ring 300 provides exceptional heat transfer qualities. This is because laminar flow is maintained at a very high Reynolds number, as will be understood by those skilled in fluid heat transfers.

Figure 7:
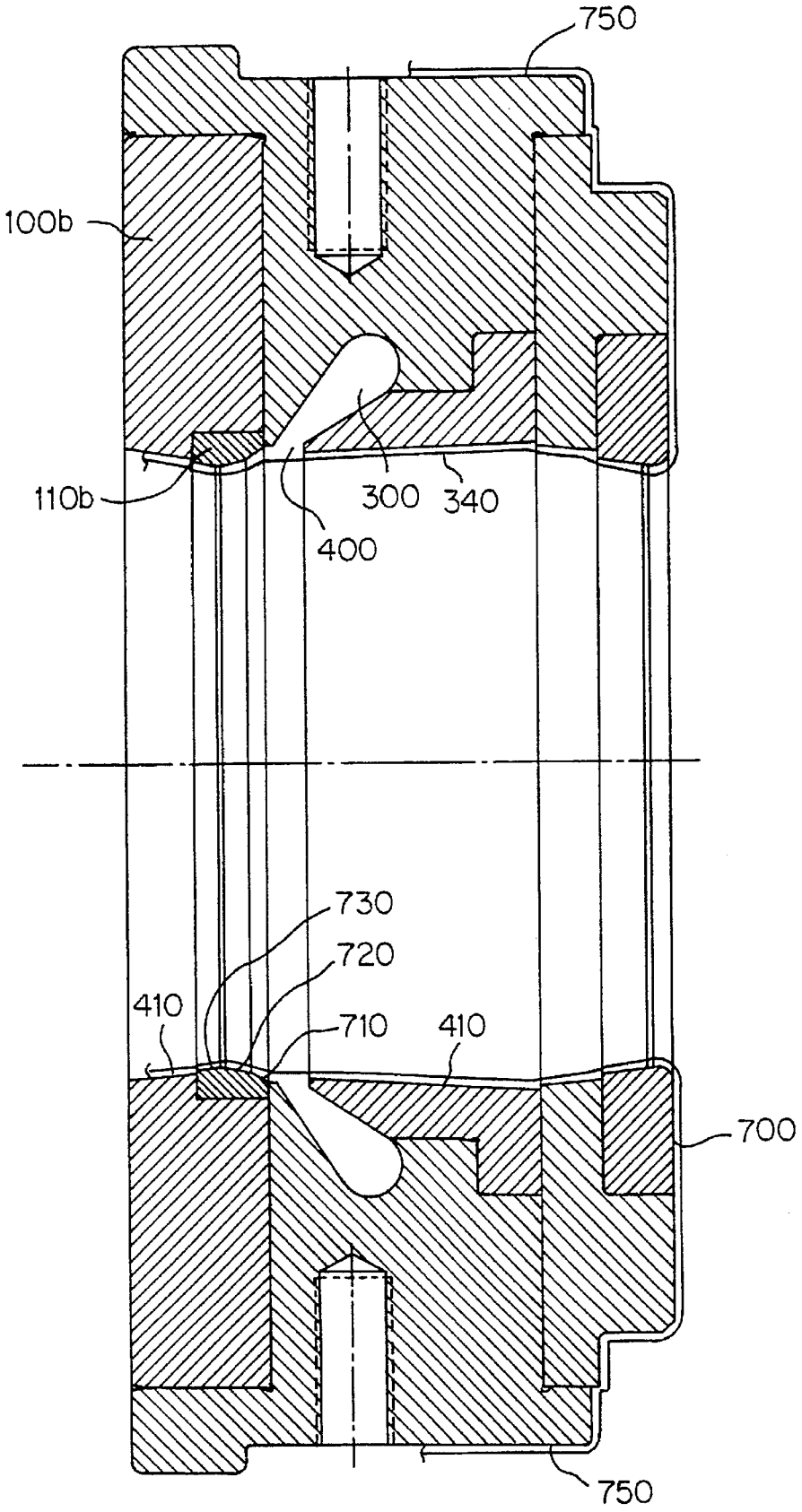
FIG. 7 depicts the flow of lubricant over the die nibs in accordance with the present invention.
Figure 8A:
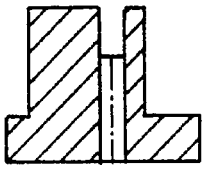
Figure 8B:
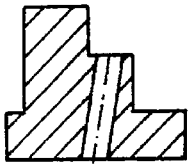
Figure 8C:
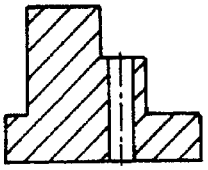
Figure 8D:
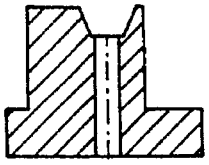
Figure 8E:
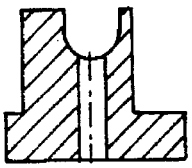
Figure 8F:
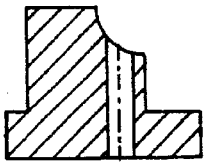

FIG. 7 is similar to FIG. 5, but depicts the flow of fluid 340 over the nib 110*b*, the cavity 160 surfaces 410 and outside surfaces 700 and 750 of the assembly 20. In FIG. 7, the surface of nib 110*b* includes an entrance angle surface 710, a land surface 720 and an exit angle surface 730. In the normal operation of the assembly 20, the workpiece 150 strikes the entrance angle surface 710 of the nib 110*b* and bears against the entrance angle and land surfaces 710 and 720 of nib 110*b* to work the sidewalls of the workpiece. Accordingly, it is particularly important from a lubricating and cooling standpoint for the fluid to be in a laminar flow over surfaces 710 and 720.

As depicted in FIG. 7, in our test laminar flow of fluid 340 was maintained after flowing from the opening 400 of lube ring 300. The thickness of the flow over the cavity surface 410 and nib surfaces 710, 720 and 730 remained substantially constant. Virtually no turbulence was detectable. As indicated in FIG. 7, the fluid 340 also maintained a laminar flow over the outer side surfaces 700 of the die/lube ring assembly which is shown in FIG. 7 as only a portion of the full assembly. Additionally, laminar flow was maintained even as the fluid continued its flow from the outer side surfaces of the assembly to the top and bottom surfaces 750 of the assembly. Notably, the assembly could be rotated or oriented in any manner without effecting the steady laminar flow as depicted in FIG. 7 over the surfaces of the assembly.

While the invention has been described in terms of a preferred embodiment having a horizontally orientated die/lube ring assembly, as noted above the orientation of the assembly will not materially effect the laminar flow over the surfaces of the assembly in accordance with the invention as disclosed herein. Although it is customary for the die/lube ring assembly to have a horizontal orientation within the bodymaker, if desired the assembly could be vertically or diagonally or otherwise disposed within the bodymaker. In such an alternative orientation, the forces tending to separate the lubricating fluid from the surfaces of the groove 360 and nib 110*b* and from the cavity wall surface 410 may be somewhat reduced. Accordingly, the velocity of the lubrication fluid introduced to the groove could in theory also be reduced, since the centrifugal force required to maintain a laminar flow of the lubricating fluid on the surfaces of the groove 360 and nib 110*b* and on the cavity wall surface 410 would be reduced in correlation with the reduction of the forces acting to separate the fluid from these surfaces. However, as has been discussed above, preferably the introduction velocity of the lubricating fluid into the groove is such that the corresponding centrifugal force developed on the fluid is well in excess of the gravitational force acting on the fluid and therefore, in practice, the orientation of the die/lube ring assembly need not effect the selected introduction velocity of the fluid or other aspects of the invention as described herein.

As described above, the present invention provides a laminar flow of lubricant over the nibs of the die rings thereby providing enhanced lubrication and cooling characteristics during the operation of the bodymaker. Due to the use of centrifugal forces, the orientation of the opening or openings in the lubricating ring and the velocity of the lubricant introduced into the lubricating ring, so long as it equals or exceeds a minimum required velocity to develop the necessary centrifugal force, are not critical to the application of the lubricant to the nibs of the die rings. A continuous laminar flow of lubricant is provided to the nib surfaces thereby providing continuous lubricating, cooling and cleaning of these surfaces while the bodymaker is in operation, i.e., both during the working of the workpiece into the finished container as well as during other periods of operation. Due to the velocity at which the lubricant enters the assembly cavity, the lubricant flow is directed along and against the nib surface without depending on the workpiece distributing the lubricant within the cavity.

In testing the above-described invention, a significant reduction in nib wear and tearing of workpieces was experienced. Punch degradation was also reduced. Decreases in workpiece tear-off approached 50% as did the increase in the nib life. Further, the volume of lubricant required to perform the required lubrication, cooling and cleaning was reduced by approximately 50%. Accordingly, the present invention provides a significant improvement over conventional fabricating press lubrication systems.

While the invention has been described in terms of the preferred embodiment, the invention is limited thereto and the claims appended hereto will encompass other embodiments which come within the scope of the invention disclosed herein. Those skilled in the art will recognize other applications in which the techniques described herein can be utilized.

Novel features and characteristics of the invention are set forth in the appended claims. The invention itself, however, as well as other features, advantages and benefits thereof, will be best understood by reference to the above detailed description and the accompanying drawings.

What is claimed is:

1. A lubrication ring for use in a fabrication press including an assembly having a main cavity and a die nib disposed on a surface of said cavity for ironing a workplace passing through said cavity, comprising:

a groove surrounding a periphery of said main cavity and opening into said cavity; and at least one passage for introducing a fluid into said groove so as to flow within said groove;

wherein a centrifugal force on said fluid flowing in said groove exceeds a gravitational force acting on said fluid.

2. A lubrication ring according to claim 1, wherein said passage is adapted to introduce said fluid into said groove at a velocity and said centrifugal force corresponds to said velocity.

3. A lubrication ring according to claim 1, wherein said passage is adapted to introduce a volume of said fluid into said groove so that a portion of said fluid flows from said groove.

4. A lubrication ring according to claim 1, wherein said at least one passage is four passages.

5. A lubrication ring according to claim 1, wherein said at least one passage is a plurality of passages.

6. A lubrication ring according to claim 1, wherein said at least one passage is adapted to introduce a continuous flow of fluid into said groove.

7. A lubrication ring according to claim 1, wherein said at least one passage is disposed substantially tangential to said groove.

8. A lubrication ring according to claim 1, wherein said at least one passage is disposed such that said introduced fluid will flow in said groove in a single radial direction circumferentially around the periphery of said cavity.

9. A lubrication ring according to claim 3, wherein a centrifugal force on said portion of the fluid flowing from said groove opening is equal to or greater than a gravitational force on said portion of the fluid.

10. A lubrication ring according to claim 3, wherein:

said groove is adapted such that the portion of said fluid flows from said groove opening and along a surface of said die nib, and said portion of the fluid has a laminar flow from said groove and onto said nib surface.

11. A lubrication ring according to claim 3, wherein said portion of the fluid flow contiguously between said groove opening and a surface of said die nib.

12. A lubrication ring according to claim 3, wherein said portion of the fluid flows over said die nib and a centrifugal force on said portion of the fluid flowing over said nib equals or exceeds a gravitational force acting on said portion of the fluid.

13. An ironing press comprising:

an assembly having a cylindrical main cavity with a substantially horizontal main axis and a plurality of die nibs disposed on a surface of said cavity;

a press for forcing a workpiece through said cavity;

a groove encircling said main cavity and forming a continuous opening in the surface of said cavity; and a plurality of passages disposed substantially tangential to said groove for introducing a continuous flow of fluid into said groove at a velocity such that said fluid flows in a single radial direction within said groove and a centrifugal force corresponding to said velocity and which exceeds a gravitational force acts on said fluid flowing in said groove;

wherein fluid flowing from said groove opening maintains a substantially laminar flow over said die nib.

14. A method of lubrication in a sheet metal forming press having walls defining a main cavity having a longitudinal axis, a toroidal die nib disposed on the interior surface of the cavity for forming a workpiece passing axially through the cavity, and a groove which surrounds and opens into the cavity, which method comprises the steps of:

introducing a fluid into the groove in such a direction and at such a velocity as to cause fluid in the groove to rotate circumferentially about the axis of the cavity, with the velocity of the rotating fluid being sufficient to create a high centrifugal force urging the fluid into continuous contact with the radially outer surface of the groove, and flowing the rotating fluid out of the groove and onto the nib, with the velocity of the rotating fluid being sufficient to create a high centrifugal force urging the fluid into continuous and intimate contact with the radially inner surface of the nib, thereby completely and uniformly coating that nib surface with a layer of rotating fluid.

15. A method according to claim 14, wherein said centrifugal forces, both before and after the fluid flows out of the groove, exceed gravitational forces on the fluid.

16. A method according to claim 14, wherein said fluid flow, both inside and outside of the groove, is substantially laminar.

17. A method according to claim 14, wherein the fluid flows continuously during a period of operation of the press.

18. A method according to claim 14, wherein the cavity is substantially cylindrical, the groove is substantially circular and continuous, and the fluid is introduced into the groove in a direction tangential to the groove, via a passageway extending through the wall.

19. A method according to claim 14, wherein said fluid flow outside the groove forms a layer of fluid along the interior surface of the cavity.

20. A method according to claim 19, wherein the shape and dimensions of the layer are determined by the shape of the cavity surface and by said centrifugal forces, rather than by the surface of the workpiece.

* * * * *